US007798599B2

(12) United States Patent
Michael et al.

(10) Patent No.: US 7,798,599 B2
(45) Date of Patent: Sep. 21, 2010

(54) FLUID-EJECTION DEVICE SERVICE STATION

(75) Inventors: Donald Lee Michael, Monmouth, OR (US); William E. Lewey, Albany, OR (US); Kevin E. Swier, Albany, OR (US); Anthony D. Studer, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 877 days.

(21) Appl. No.: 11/679,643

(22) Filed: Feb. 27, 2007

(65) Prior Publication Data

US 2008/0204507 A1 Aug. 28, 2008

(51) Int. Cl.
*B41J 2/165* (2006.01)

(52) U.S. Cl. ..... 347/33; 347/29

(58) Field of Classification Search ..... 347/109, 347/33, 29

See application file for complete search history.

(56) References Cited

U.S. PATENT DOCUMENTS 6,637,856 B2 10/2003 Nishi et al.
6,659,586 B2 12/2003 Balcan
7,175,257 B2 * 2/2007 Park et al. ..... 347/45
7,210,760 B2 * 5/2007 Monclus et ..... 347/29
7,335,249 B2 * 2/2008 Goto et al. ..... 106/31.27
7,399,054 B2 * 7/2008 Morgan et al. ..... 347/22
7,556,371 B2 * 7/2009 Silverbrook ..... 347/109
2006/0221118 A1 10/2006 Na et al.
2007/0195151 A1 * 8/2007 Anderson et al. ..... 347/109
2008/0024570 A1 1/2008 Studer
2008/0049086 A1 2/2008 Rolly
2008/0180494 A1 7/2008 Studer
2008/0180719 A1 7/2008 Lutnesky
2009/0033950 A1 2/2009 Studer

OTHER PUBLICATIONS

International Search Report for Application No. PCT/US2008/053147. Report issued May 29, 2008.

* cited by examiner

*Primary Examiner*—Julian D Huffman
*Assistant Examiner*—Jason S Uhlenhake

(57) ABSTRACT

A service station for a fluid-ejection mechanism of a fluid-ejection device includes one or more mechanisms. The mechanisms move back and forth over the fluid-ejection mechanism to wipe the fluid-ejection mechanism. The mechanisms cap the fluid-ejection mechanism during periods of nonuse of the fluid-ejection mechanism. The service station is mounted on the fluid-ejection mechanism, and remains mounted on the fluid-ejection mechanism while the fluid-ejection mechanism is used to eject fluid onto media. The fluid-ejection device is moved by a user to properly eject the fluid onto the media.

20 Claims, 8 Drawing Sheets

FLUID-EJECTION DEVICE SERVICE STATION

BACKGROUND

Inkjet-printing devices, such as inkjet printers, are devices that eject ink onto media to form images on the media. Conventionally, an inkjet-printing device feeds media past an inkjet-printing mechanism, such as an inkjet printhead, in a first direction. The inkjet-printing mechanism moves relative to the media in a second direction perpendicular to the first direction, ejecting ink onto a swath of the media in accordance with a portion of the image to be formed. The inkjet-printing device advances the media so that a new swath is incident to the inkjet-printing mechanism, and the mechanism again moves relative to the media to eject ink onto this new swath. This process is repeated until the desired image is formed on the media.

By comparison, a handheld inkjet-printing device relies upon a user to move the device over a swath of media to properly eject ink onto the media to form a desired image. Such handheld inkjet-printing devices are useful in environments like shipping environments, for instance, in which tags, such as bar codes and other identifiers, are to be quickly imaged on media like packages. An example of such a handheld inkjet-printing device is described in the previously filed patent application entitled "Print Device Preconditioning," filed on Jan. 30, 2007, and assigned Ser. No. 11/669,149.

Inkjet-printing devices commonly need to be serviced. Such servicing can involve wiping inkjet-printing nozzles of the inkjet-printing mechanism, as well as spitting ink from the nozzles, to ensure that the nozzles properly eject ink when called upon to form an image on media. In a conventional inkjet-printing device, typically the inkjet-printing mechanism is moved to a service station within the device at which servicing is performed. The analog for a handheld inkjet-printing device is a docking station in which the device is placed while not being used to form an image on media. However, it can be inconvenient to expect the user to dock the handheld inkjet-printing device any time the device is not being used so that servicing can be performed.

DETAILED DESCRIPTION OF THE DRAWINGS

Figure 1A:
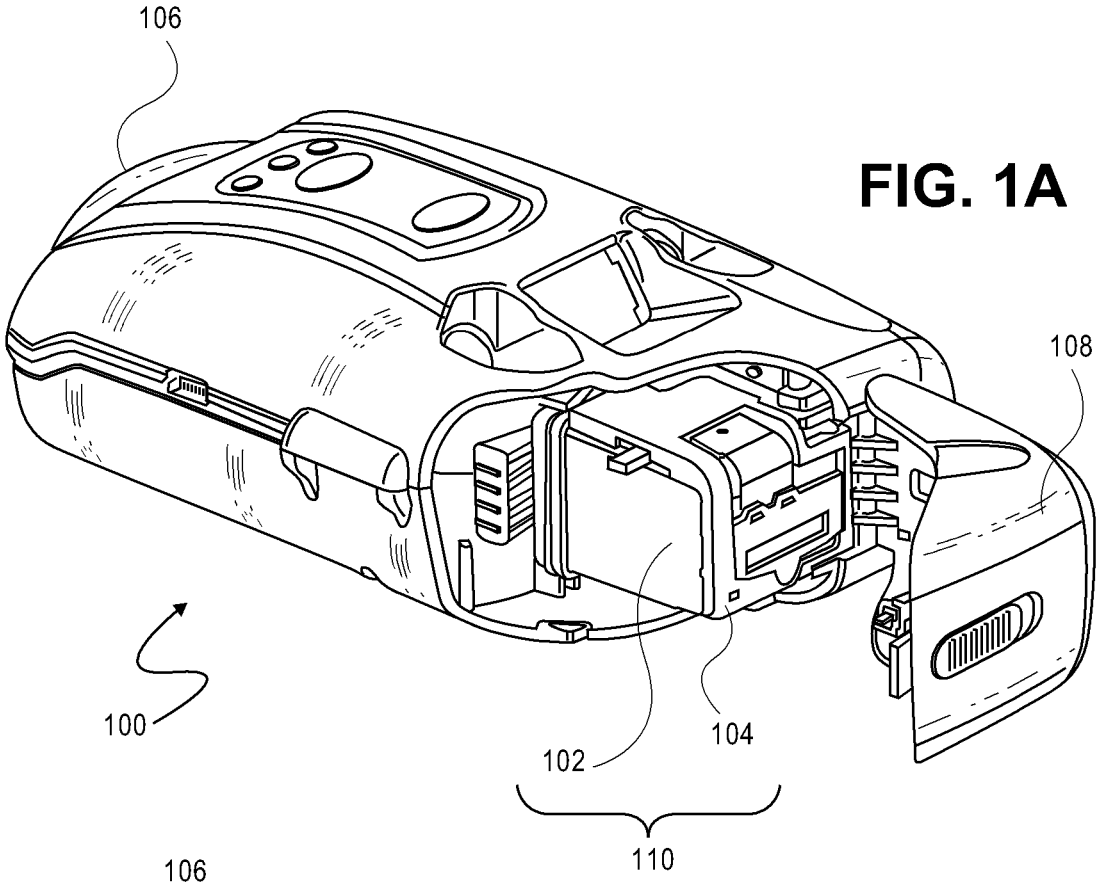
FIGS. 1A, 1B, and 1C are diagrams of a representative handheld fluid-ejection device, according to an embodiment of the invention.
Figure 1B:
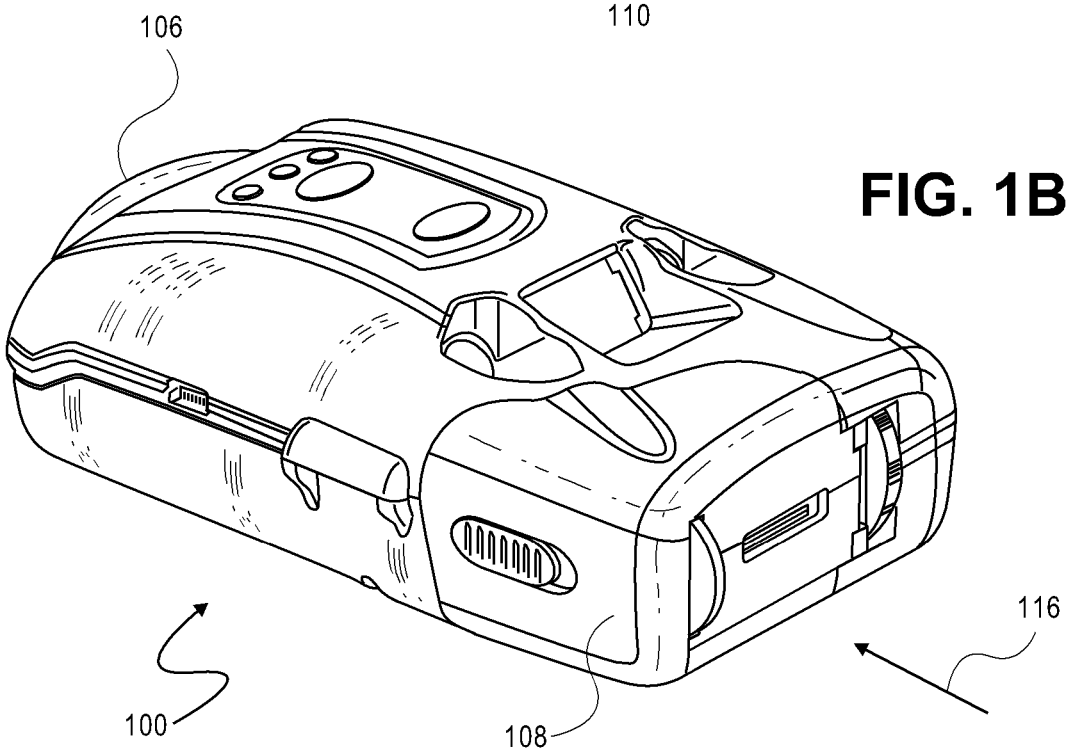
Figure 1C:
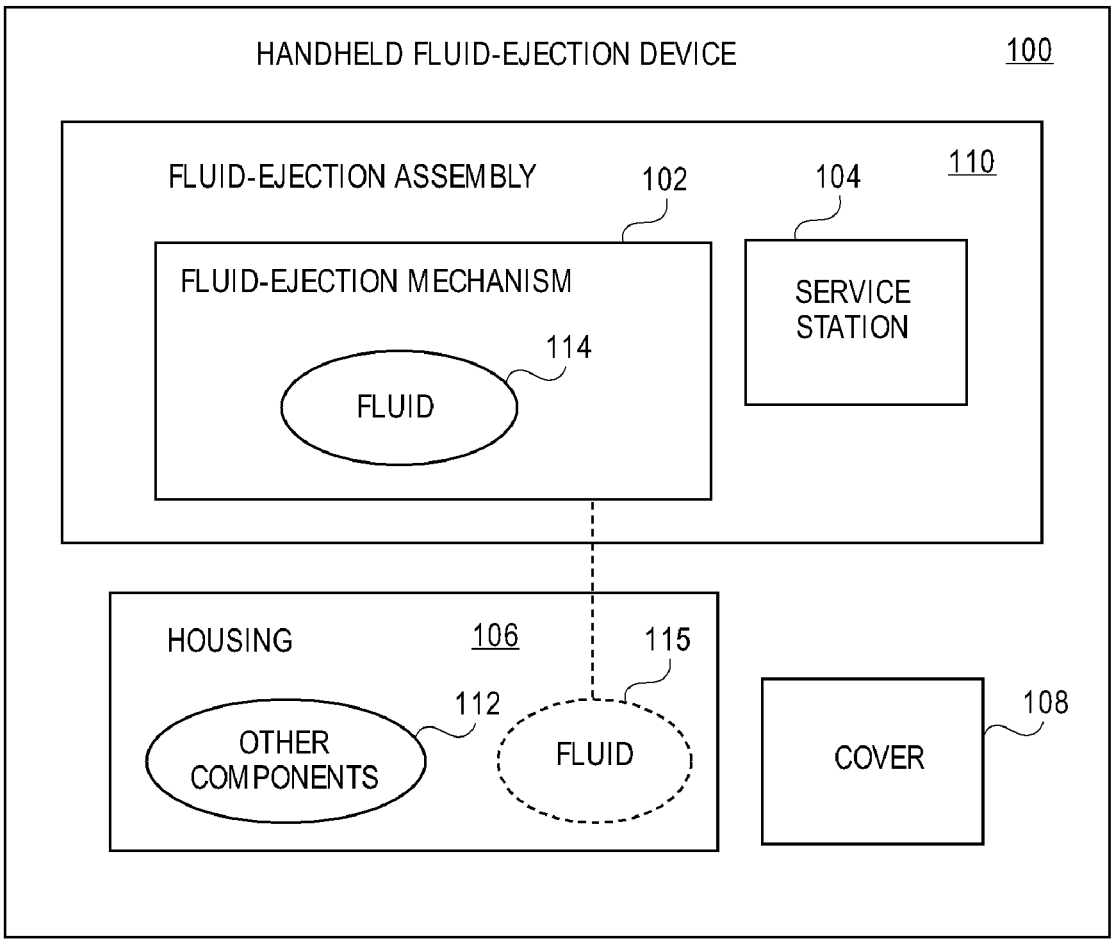

FIGS. 1A, 1B, and 1C show a representative handheld fluid-ejection device 100, according to an embodiment of the invention. Specifically, FIGS. 1A and 1B show perspective views of the handheld fluid-ejection device 100 with the cover 108 of the device 100 opened and closed, respectively. By comparison, FIG. 1C shows a block diagram of the handheld fluid-ejection device 100. It is noted that while certain components and mechanisms of the handheld fluid-ejection device 100 are particularly called out in FIGS. 1A, 1B, and 1C, the device 100 can and typically will include other components and mechanisms, in addition to and/or in lieu of those described herein.

The handheld fluid-ejection device 100 can in one embodiment be that which is described in the previously filed patent application entitled "Print Device Preconditioning," filed on Jan. 30, 2007, and assigned Ser. No. 11/669,149. The handheld fluid-ejection device 100 may in one embodiment be a handheld inkjet-printing device that ejects ink to form an image on media. The fluid-ejection device 100 is handheld in that a user holds the device 100 in his or her hand while the device 100 is ejecting fluid on media. Furthermore, the user moves the fluid-ejection device 100 so that the device 100 properly ejects fluid on the media so that, for instance, the device 100 properly forms an image on the media. In other embodiments, the device 100 may have additional mounting features such that it can be used in different orientations but still ejects fluid in a similar manner, as can be appreciated by those of ordinary skill within the art. Furthermore, it is noted that the terminology media as used herein is generally considered to be any surface on which fluid is ejected by the fluid-ejection device 100. The term media, however, is not to be confused with the wiping mechanism and/or the capping mechanism, as to which these latter two terms are described in more detail later in the detailed description.

The handheld fluid-ejection device 100 includes a fluid-ejection mechanism 102 that is removably inserted into the device 100 when the cover 108 of the device 100 is opened. The fluid-ejection mechanism 102 may be an inkjet-printing mechanism, such as an inkjet printhead, and can include a supply of fluid 114, like ink, that is ejected from the mechanism 102. A service station 104 is removably or permanently affixed to the fluid-ejection mechanism 102. The service station 104 wipes the fluid-ejection mechanism 102 and caps the mechanism 102 during periods of nonuse, as is described in more detail later in the detailed description. The fluid-ejection mechanism 102 and the service station 104 may together be considered a fluid-ejection assembly 110. The fluid-ejection mechanism 102 may be a thermal fluid-ejection mechanism, such as a thermal inkjet mechanism, a piezoelectric fluid-ejection mechanism, such as a piezoelectric inkjet mechanism, or another type of fluid-ejection mechanism.

The handheld fluid-ejection device 100 further includes a housing 106 in which the fluid-ejection mechanism 102 is removably inserted. The housing 106 contains a number of other components 112. Generally, these components 112 control the fluid-ejection mechanism 102 to eject fluid onto media as the user moves the handheld fluid-ejection device 100. For example, such components 112 can include user-interface mechanisms like buttons and switches, semiconductor integrated circuits (IC's), encoders, imagers, sensors, as well as other types of components.

Generally, in operation the user holds the handheld fluid-ejection device 100 in one of his or her hands and positions the device 100 so that the surface indicated by the arrow 116 is pressed against the media on which the user wishes to eject fluid. The user then moves the fluid-ejection device 100 over the media. As the fluid-ejection device 100 is moved, the fluid-ejection mechanism 102 ejects fluid onto the media so that, for instance, a desired image is formed on the media.

It is noted that in another embodiment, the fluid ejection mechanism 102 may be an inkjet-printing mechanism, such as an inkjet printhead, where may be a separate supply of fluid 115 that is fluidically coupled to the printhead. This supply of fluid 115 may be located such that it can be attached directly to the fluid-ejection mechanism 102 or be located remotely within the handheld fluid ejection device 100.

Figure 2:
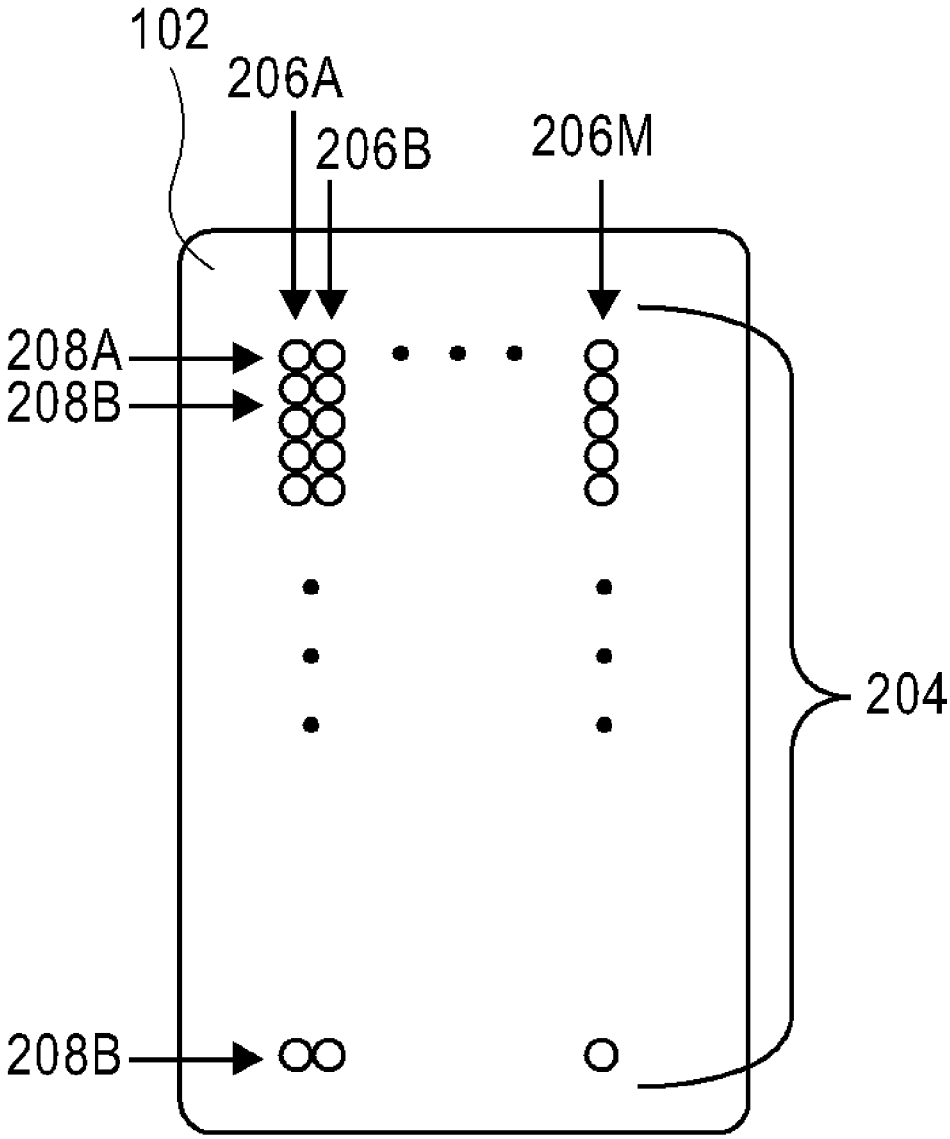
FIG. 2 is a diagram of a fluid-ejection mechanism having a number of fluid-ejection nozzles, according to an embodiment of the invention.

FIG. 2 shows a detailed view of the surface of the fluid-ejection mechanism 102 from which fluid is ejected, according to an embodiment of the invention. Particularly, the fluid-ejection mechanism 102 includes a number of fluid-ejection nozzles 204, such as inkjet nozzles. The fluid-ejection nozzles 204 are organized over a number of columns 206A, 206B, . . . , 206M, collectively referred to as the columns 206, and a number of rows 208A, 208B, . . . , 208N, collectively referred to as the rows 208. In one embodiment, for example, there may be 4 columns 206 and 168 rows 208, for a total of 672 fluid-ejection nozzles 204.

The fluid-ejection nozzles 204 are the orifices from which ink, or fluid, is ejected out of the fluid-ejection mechanism 102. The surface of the fluid-ejection mechanism 102 shown in FIG. 2 may be referred to as the orifice plate, which comes into close contact with media so that fluid can be precisely ejected from the fluid-ejection nozzles 204 onto the media in a desired manner. It is noted that the fluid-ejection nozzles 204 are organized in aligned columns 206 in the example of FIG. 2. However, in another embodiment, the fluid-ejection nozzles 204 may be organized in columns 206 such that adjacent columns are staggered relative to one another.

The fluid-ejection nozzles 204 of the fluid-ejection mechanism 102 can be susceptible to clogging by dried fluid that can degrade image quality, and the orifice plate of the mechanism 102 can also harbor dried fluid that can degrade image quality. Therefore, the fluid-ejection mechanism 102 is desirably periodically serviced, by wiping the fluid-ejection nozzles 204, for instance, to ensure that the nozzles 204 properly eject fluid. Likewise, the fluid-ejection nozzles 204 are desirably capped, or closed, during periods of nonuse of the fluid-ejection mechanism 102. Such servicing and capping are performed by the service station 104, different embodiments of which are now described in detail.

Figure 3A:
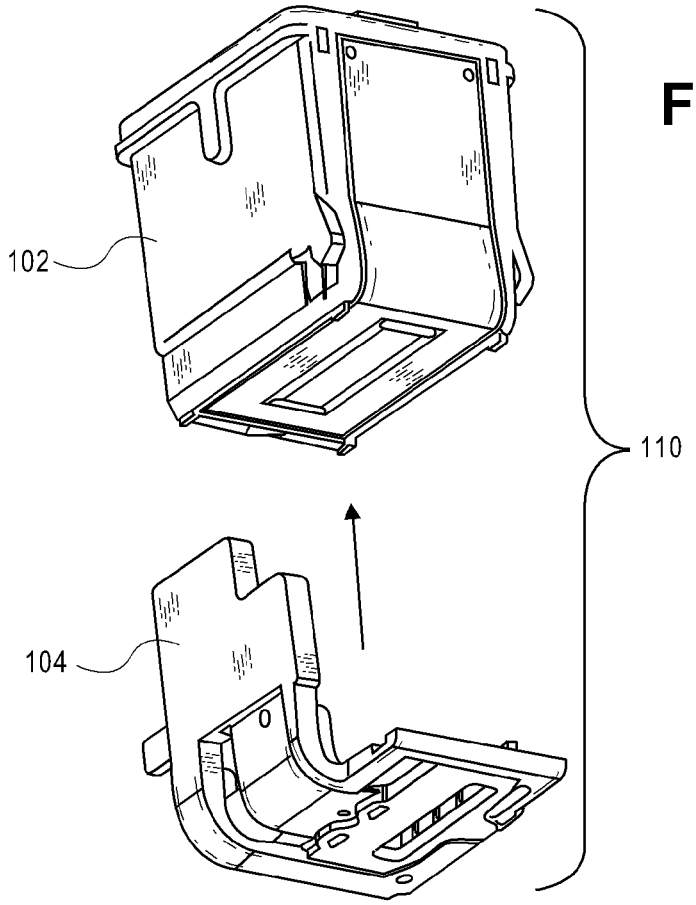
FIGS. 3A and 3B are diagrams of a fluid-ejection assembly including a fluid-ejection mechanism and a service station, according to an embodiment of the invention.
Figure 3B:
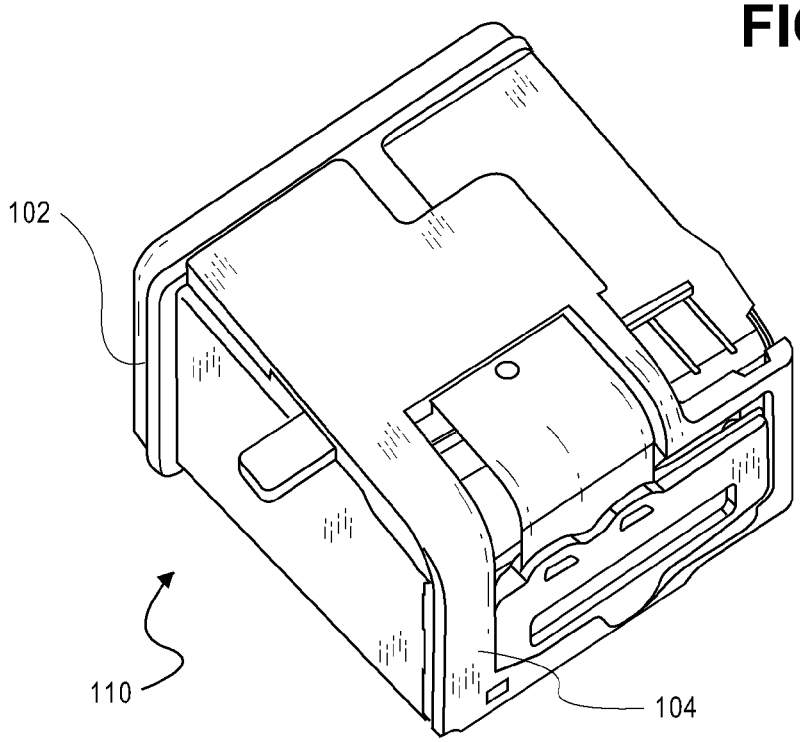

FIGS. 3A and 3B show the fluid-ejection assembly 110, according to an embodiment of the invention. The fluid-ejection assembly 110 includes the fluid-ejection mechanism 102 and the service station 104. In FIG. 3A, the service station 104 has been removed from the fluid-ejection mechanism 102. By comparison, in FIG. 3B, the service station 104 has been affixed to the fluid-ejection mechanism 102.

In one embodiment, the service station 104 is permanently affixed to the fluid-ejection mechanism 102, and cannot be removed after having been mounted to the fluid-ejection mechanism 102. Thus, when the fluid-ejection mechanism 102 needs replacing, such as, for instance, due to having run out of fluid, the entire fluid-ejection assembly 110 is removed from the fluid-ejection device 100 and replaced with a new assembly 110. The new fluid-ejection assembly 110 includes a new fluid-ejection mechanism 102 and a new service station 104 that has been permanently affixed to the mechanism 102.

By comparison, in another embodiment, the service station 104 is removably attached to the fluid-ejection mechanism 102, and can be removed after having been mounted to the fluid-ejection mechanism 102. Thus, when the fluid-ejection mechanism 102 needs replacing, the fluid-ejection assembly 110 is removed from the fluid-ejection device 100, and the service station 104 is removed from the old fluid-ejection mechanism 102. The service station 104 is then mounted to a new fluid-ejection mechanism 102, and the resulting fluid-ejection assembly 110—include the new mechanism 102 but the old service station 104—is inserted into the fluid-ejection device 100. In other embodiments, the service station 104 or fluid ejection mechanism 102 may be captured by the device 100 upon removal such that either or both the station 104 and the mechanism 102 can be later removed from device 100 and replaced.

Figure 4A:
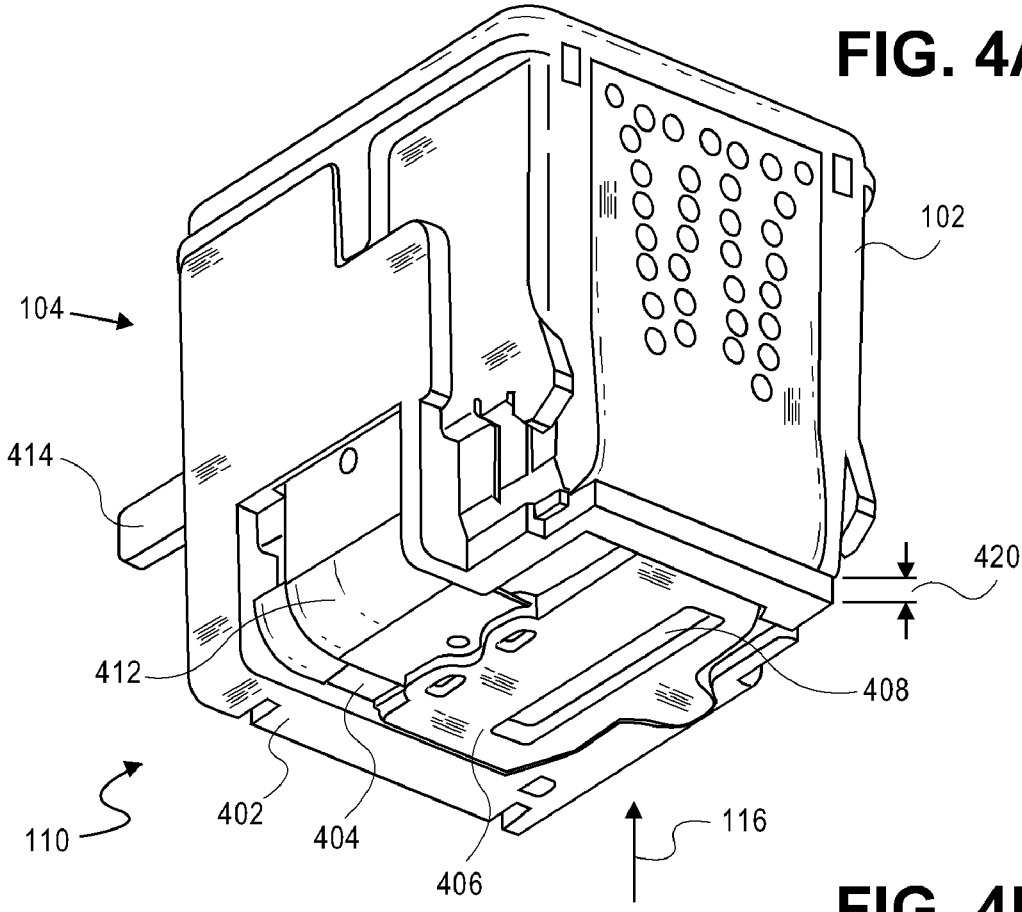
FIGS. 4A and 4B are diagrams of a service station for a fluid-ejection mechanism of a handheld fluid-ejection device, according to an embodiment of the invention.
Figure 4B:
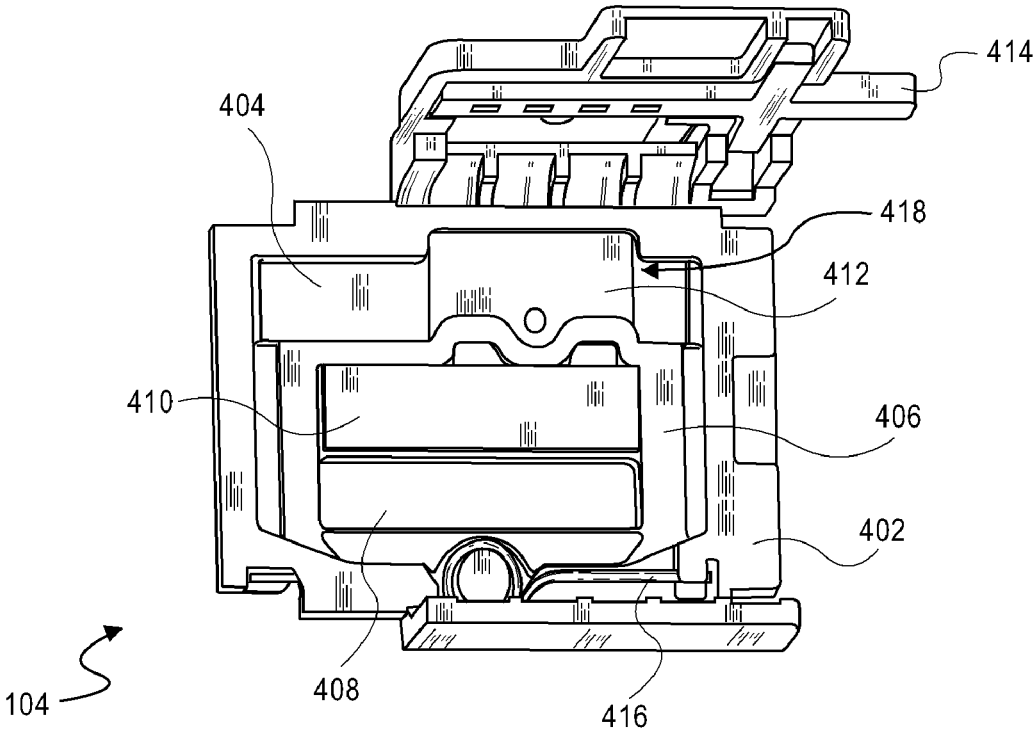

FIGS. 4A and 4B show the service station 104 in detail, according to an embodiment of the invention. In FIG. 4A, the service station 104 has been mounted on the fluid-ejection mechanism 102, such that the entire fluid-ejection assembly 110 is depicted. By comparison, in FIG. 4B, just the service station 104 is shown. In particular, in FIG. 4B, the side of the service station 104 that mounts to the fluid-ejection mechanism 102 is depicted. In another embodiment, the service station 104 may mount to additional sides of the fluid-ejection mechanism 102 as well.

The service station 104 includes an L-shaped housing 402 that mounts to the fluid-ejection mechanism 102. The housing 402 of the service station 104 can in one embodiment change the overall shape of the fluid-ejection assembly 110 such that the assembly 110 is substantially prevented from being inserted into the fluid-ejection device 100 incorrectly. That is, upon the service station 104 being mounted to the fluid-ejection mechanism 102, the fluid-ejection mechanism 102 can be attached to the fluid-ejection device 100 in just the correct way, preventing the user from incorrectly inserting the fluid-ejection assembly 110 into the device 100 incorrectly.

The housing 402 of the service station 104 defines an opening 404. A shutter 406 of the service station 104 is movably disposed within the opening 404 of the housing 402. The shutter 406 is more generally a wiping mechanism, and moves back and forth over the fluid-ejection mechanism 102, within the opening 404, to wipe the fluid-ejection mechanism 102. More specifically, the surface of the fluid-ejection mechanism 102 against which the shutter 406 is located in FIG. 4A is that which has been described in relation to FIG. 2 as including the fluid-ejection nozzles 204 of the fluid-ejection mechanism 102. Movement of the shutter 406 is thus back and forth over this surface of the fluid-ejection mechanism 102, and therefore over the fluid-ejection nozzles 204.

The shutter 406 of the service station 104 defines a slot 408. In the position of the shutter 406 within the opening 404 of the housing 402 depicted in FIG. 4A, the fluid-ejection nozzles 204 of the fluid-ejection mechanism 102 are not exposed through the slot 408. Rather, the fluid-ejection nozzles 204 are exposed through the slot 408 when the shutter 406 moves to the other side of the opening 404, which is indicated by the reference number 418 in FIG. 4B. Therefore, by moving the shutter 406 within the opening 404 back and forth between these two positions, the fluid-ejection nozzles 204 are alternately not exposed and exposed through the slot 408. When the fluid-ejection nozzles 204 are exposed through the slot 408, they are capable of ejecting fluid onto media as desired by a user.

As particularly depicted in FIG. 4A, the portion of the housing 402 that defines the slot 404 in which the shutter 406 is movably disposed, as well as the shutter 406 itself, add a distance 420 from the surface of the fluid-ejection mechanism 102 that includes the fluid-ejection nozzles 204 of FIG. 2. This surface, indicated by the arrow 116 and as has been described in relation to FIG. 1B, is pressed by the user against media to eject fluid onto the media. The distance that the fluid travels upon ejection from the fluid-ejection nozzles 204 until it reaches the media is desirably minimized to prevent degraded image-formation quality on the media, where the fluid is particularly ink. Therefore, the distance 420 that the housing 402 and/or the shutter 406 adds is substantially insufficient to result in such degraded image-formation quality. In one embodiment, for instance, the distance 420 may be 1.5 millimeters.

As particularly depicted in FIG. 4B, disposed on the underside of the shutter 406 is a capping material 410, which is more generally a capping mechanism of the service station 104. The capping material 410 maintains humidification of the fluid-ejection nozzles 204 of FIG. 2 when the nozzles 204 are not exposed through the slot 408 of the shutter 406, such as during periods of nonuse of the fluid-ejection device 100. The capping material 410 may be a closed-cell foam, an open-cell foam, an integral part of the material of the shutter, a thermosetting plastic, a thermoplastic, an elastomer, a composite thereof, or another type of material. In at least some embodiments, the capping material 410 is the material that wipes the fluid-ejection nozzles 204, via the wiping action of the shutter 406. Furthermore, in another embodiment, the capping material 410 may be omitted, and replaced by, for instance, a recessed or raised area within the shutter 406, or another feature. Thus, the wiping mechanism can be same mechanism as the capping mechanism.

Therefore, in one embodiment, the shutter 406 of the service station 104 defaults to the position depicted in FIG. 4A, in which the fluid-ejection nozzles 204 of FIG. 2 are not exposed through the slot 408. In this position of the shutter 406, the fluid-ejection nozzles 204 are capped by the capping material 410 on the underside of the shutter 406. That is, the capping material 410 is positioned incident to the fluid-ejection nozzles 204 in this position of the shutter 406. In this embodiment, it can be said that the shutter 406 is normally closed, in that the fluid-ejection nozzles 204 are normally not exposed through the slot 408 of the shutter 406.

However, in another embodiment, the shutter 406 of the service station 104 may be normally open, such that the shutter 406 defaults to the position at the other side of the opening 404 indicated by the reference number 418 in FIG. 4B. In this position of the shutter 406, the fluid-ejection nozzles 204 of FIG. 2 are exposed through the slot 408. That is, in this position of the shutter 406, the fluid-ejection nozzles 204 are not capped by the capping material 410 on the underside of the shutter 406.

In the embodiment of FIGS. 4A and 4B, movement of the shutter 406 within the opening 404 from the position depicted in FIGS. 4A and 4B to the position in which the shutter 406 is at the other side of the opening 404 indicated by the reference number 418 in FIG. 4B results in the shutter 406 wiping the fluid-ejection nozzles 204 of FIG. 2. Substantially any fluid, be it liquid or dried, on the fluid-ejection nozzles 204 and/or on the surface of the fluid-ejection mechanism 102 on which the nozzles 204 are disposed is wiped towards the end of the opening 404 of the housing 402 indicated by the reference number 418 in FIG. 4B. Therefore, by the shutter 406 moving within the opening 404 so that the fluid-ejection nozzles 204 become exposed through the slot 408 and are no longer capped by the capping material 410, the nozzles 204 are wiped.

Thus, the shutter 406 performs a service operation known as wiping, in which the fluid-ejection nozzles 204 are wiped to clear any liquid or dried fluid from the nozzles 204. Furthermore, a service operation known as spitting in which fluid is ejected from the fluid-ejection nozzles 204 to assist in clearing clogs, may be performed while the nozzles 204 are positioned adjacent to the capping material 410. That is, the fluid output during such spitting is ejected from the fluid-ejection nozzles 204 onto the capping material 410. In such an embodiment, the capping material 410 therefore serves to maintain humidification of the fluid-ejection nozzles 204 when the nozzles 204 are capped, and may also act as a spittoon to collect the fluid ejected from the fluid-ejection nozzles 204 during spitting. Humidification in this sense generally and non-restrictively means ensuring that the fluid-ejection nozzles 204 do not dry out when not in use.

It is noted that, as has been previously described, when the shutter 406 has wiped the fluid ejection nozzles 204 of FIG. 2 and exposed them through slot 408, the capping material 410 is located adjacent to the fluid ejection nozzles 204. Consequently, the nearby area in contact with and adjacent to the capping material 410 may become wetted with fluid. Over time, due to the evaporative process, the viscosity of the fluid may change making it undesirable to transfer this fluid back onto the nozzles 204 when the shutter returns to the first, default position. To minimize this issue, a hydrophobic (i.e., low surface energy) surface treatment may be applied to the adjacent area of the fluid-ejection mechanism 102. This treatment may include, but is not limited to: constructing the adjacent area of a hydrophobic material, applying a hydrophobic coating, applying a film, tape, label, or a combination thereof.

Movement of the shutter 406 within the opening 404 of the housing 402 is achieved in one embodiment as follows. A non-elastic flexible member 412 such as a flexible belt and which may be a polyimide film, or another type of material, attaches the shutter 406 to a mechanical actuator 414, such as a lever. Actuation of the mechanical actuator 414 pulls the non-elastic flexible member 412, causing the shutter 406 to move from the position depicted in FIGS. 4A and 4B to the position at the other end of the opening 404 of the housing 402 indicated by the reference number 418 in FIG. 4B. The mechanical actuator 414 may be actuated by a user, or under control of the fluid-ejection device 100 itself.

At the other side of the shutter 406 from the side at which the non-elastic flexible member 412 is attached to the shutter 406, a tension spring 416 is attached to the shutter 406. After the mechanical actuator 414 has been actuated so that the shutter 406 is moved to the position at the end of the opening 404 indicated by the reference number 418 in FIG. 4B, subsequent release of the mechanical actuator 414 results in the tension spring 416 pulling the shutter 406 back to the position depicted in FIGS. 4A and 4B. As has been described, in one embodiment this position of the shutter 406 may be the normally closed position in which the fluid-ejection nozzles 204 of FIG. 2 are capped by the capping material 410 during such periods of nonuse and are not exposed through the slot 408 of the shutter 406. It is noted that in other embodiments, the spring 416 and the non-elastic flexible member 412 may be omitted in lieu of one or more features that maintain the shutter 406 such that it is biased in one of the two positions that have been described until directly driven in either direction via other features.

The service station 104 that has been described remains mounted on the fluid-ejection mechanism 102 while the fluid-ejection mechanism 102 is used to eject fluid onto media. Before or after such fluid ejection, the fluid-ejection mechanism 102 can be serviced by the service station 104, such as by being wiped by the shutter 406, without having to dock the fluid-ejection device 100 at a docking station. That is, because the service station 104 remains mounted on the fluid-ejection mechanism 102 during usage of the fluid-ejection device 100, servicing of the mechanism 102 can substantially occur at any time, and the device 100 does not have to be moved to a separately located docking station for such servicing to occur.

Figure 5:
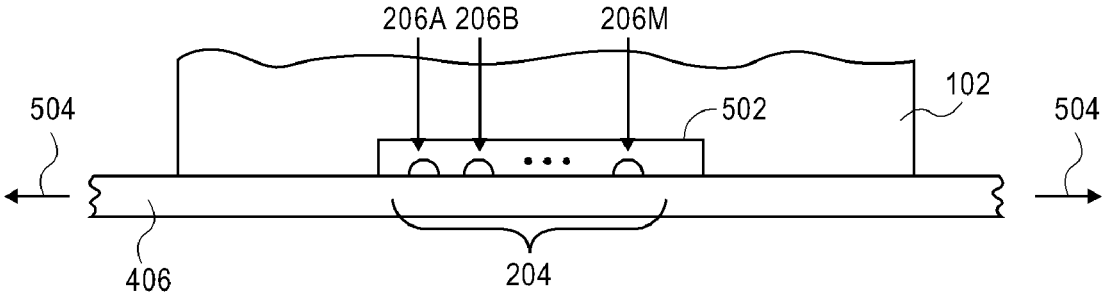
FIG. 5 is a diagram of how a shutter of a service station may move perpendicular to the columns over which the fluid-ejection nozzles of a fluid-ejection mechanism are organized, according to an embodiment of the invention.

FIG. 5 shows in more detail a side view of how the shutter 406 moves back and forth over the fluid-ejection nozzles 204 of the fluid-ejection mechanism 102 as has been described, according to an embodiment of the invention. The surface of the fluid-ejection mechanism 102 on which the fluid-ejection nozzles 204 are disposed is identified in FIG. 5 as an orifice plate, or die, 502. Just a portion of the fluid-ejection mechanism 102 is depicted in FIG. 5. The shutter 406 moves back and forth over the fluid-ejection nozzles 204, as indicated by the arrows 504. Just a portion of the shutter is depicted in FIG. 5, and the slot 408 and the wiping material 410 are not particularly shown in FIG. 5.

In this embodiment, the movement of the shutter 406 over the fluid-ejection nozzles 204 is perpendicular to the columns 206 over which the nozzles 204 are organized. Thus, fluid around the fluid-ejection nozzles 204 within the column 206B is moved past the nozzles within the column 206A when the shutter 406 is moved to the left. This is not problematic where the fluid-ejection nozzles 204 within each of the columns 206 eject the same type of fluid, such as the same color of ink. However, it may not be desirable where the fluid-ejection nozzles 204 within different columns eject different types of fluid, such as different colors of ink. For example, the fluid around the fluid-ejection nozzles 204 within the column 206B may be black ink, and the fluid around the nozzles 204 within the column 206A may be yellow ink, such that movement of the shutter 406 causes the black ink to be moved past the nozzles 204 within the column 206A, potentially contaminating these nozzles with black ink.

Figure 6:
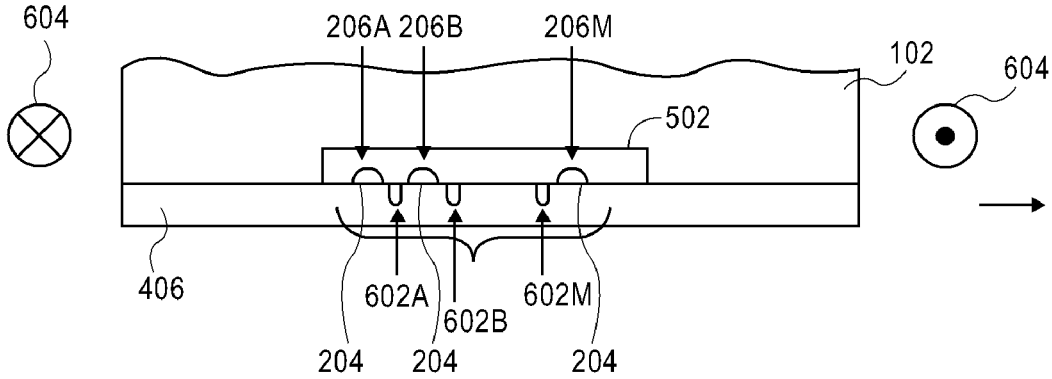
FIG. 6 is a diagram of how a shutter of a service station may alternatively move parallel to the columns over which the fluid-ejection nozzles of a fluid-ejection mechanism are organized, according to an embodiment of the invention.

Therefore, FIG. 6 shows in more detail a side view of how the shutter 406 can move back and forth over the fluid-ejection nozzles 204 of the fluid-ejection mechanism 102 to substantially avoid such potential contamination, according to an embodiment of the invention. The surface of the fluid-ejection mechanism 102 on which the fluid-ejection nozzles 204 are disposed is again identified as an orifice plate, or die, 502. As in FIG. 5, just a portion of the fluid-ejection mechanism 102 and just a portion of the shutter 406 are depicted in FIG. 6, and the slot 408 and the wiping material 410 are not particularly shown in FIG. 6.

However, unlike in FIG. 5, where the shutter 406 moves back and forth over the fluid-ejection nozzles 204 in a direction perpendicular to the columns 206 over which the nozzles 204 are organized, in FIG. 6 the shutter 406 moves back and forth over the fluid-ejection nozzles 204 in a direction parallel to the columns 206. That is, in FIG. 6, the shutter 406 moves into and out of the plane of FIG. 6, as indicated by the symbols identified by the reference number 604. Therefore, where the fluid-ejection nozzles 204 of different of the columns 206 eject different types of fluid, movement of the shutter 406 is less likely to cause fluidic cross-contamination among the nozzles 204 of different of the columns 206. In other words, the fluid-ejection nozzles 204 of the fluid-ejection mechanism 102 are wiped such that each fluid-ejection nozzle remains substantially uncontaminated by fluid of a different type than that which it ejects.

In one embodiment, such fluidic cross-contamination among the fluid-ejection nozzles 204 of the fluid-ejection mechanism 102 is further inhibited by barriers 602A, 602B, . . . , 602M, collectively referred to as the barriers 602, within the shutter 406. The barriers 602 may be ribs, trenches, or other types of barriers. The barriers 602 separate adjacent columns 206 of the fluid-ejection nozzles 206, and thus run parallel to the columns 206 along the length of the shutter 406 into the plane of FIG. 6. The barriers 602 substantially prevent fluid migrating from one of the columns 206 to another of the columns 206 while the shutter 406 is moved back and forth over the fluid-ejection nozzles 204 perpendicular to the plane of FIG. 6.

Figure 7:
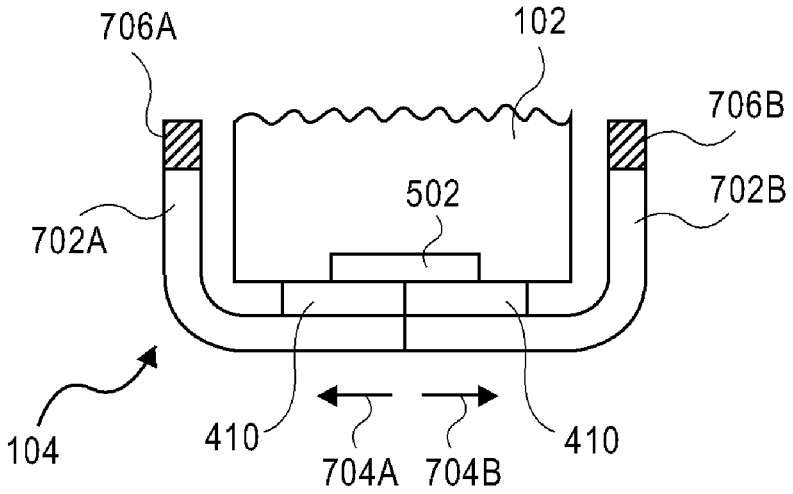
FIGS. 7, 8, 9, and 10 are diagrams of service stations for fluid-ejection mechanisms of handheld fluid-ejection devices, according to other embodiments of the invention.

FIG. 7 shows the service station 104 for the fluid-ejection mechanism 102 of the fluid-ejection device 100, according to another embodiment of the invention. The service station 104 includes two arms 702A and 702B, collectively referred to as the arms 702, and the capping material 410, which is divided between the arms 702. The capping material 410 is disposed between the arms 702 and the surface of the fluid-ejection mechanism 102 that includes the orifice plate 502 in which the fluid-ejection nozzles 204 of FIG. 2 are situated, although the nozzles 204 are not themselves depicted in FIG. 7.

In the closed position as shown in FIG. 7, the arms 702 are positioned over the orifice plate 502 of the fluid-ejection mechanism 102, such that the capping material 410 covers the orifice plate 502. Pinching the arms 702 at the locations 706A and 706B results in the arms 702 moving outwards from the fluid-ejection mechanism 102, as indicated by the arrows 704A and 704B, exposing the orifice plate 502 and hence the fluid-ejection nozzles 204 of FIG. 2. During movement of the arms 702, the arms 702, via the capping material 410, wipe the fluid-ejection nozzles 204 and the orifice plate 502.

The arms 702 can be said to be two portions of a wiping mechanism in the embodiment of FIG. 7. As such, the arms 702 are movable back and forth from the position depicted in FIG. 7 in which the arms 702 are mated with one another at their tips, to another position in which they are located away from one another. In this latter position, then, the fluid-ejection nozzles 204 of FIG. 2 are exposed, so that fluid ejection therefrom onto media can occur.

Figure 8:
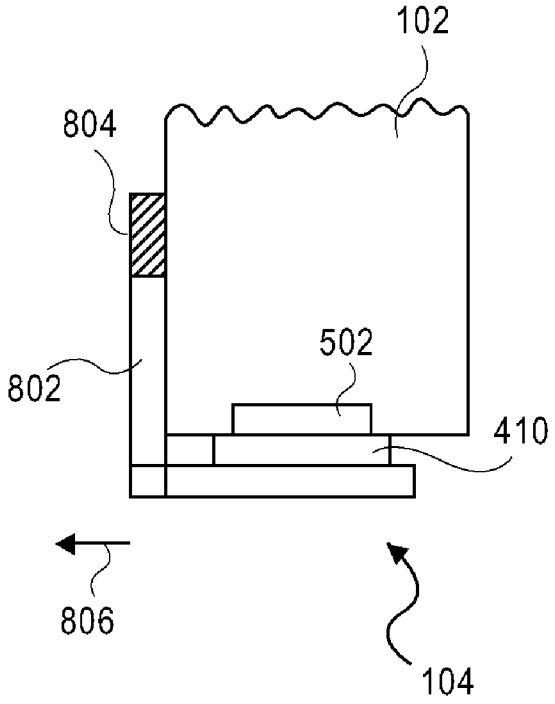

FIG. 8 shows the service station 104 for the fluid-ejection mechanism 102 of the fluid-ejection device 100, according to another embodiment of the invention. The service station 104 includes a cantilever 802 having a portion 804 that is mounted on the fluid-ejection mechanism 102, and the capping material 410. The cantilever 802 is flexibly rigid. In the closed position as shown in FIG. 8, the cantilever 802 is positioned over the orifice plate 502 on the face of the fluid-ejection mechanism 102. As before, the orifice plate includes the fluid-ejection nozzles 204 of FIG. 2, although the nozzles 204 are not themselves depicted in FIG. 8. In this position, the capping material 410 covers the orifice plate 502.

The cantilever 802 is movable so that it and the capping material 410 no longer cover the orifice plate 502 and the fluid-ejection nozzles 204 of FIG. 2, in the direction indicated by the arrow 806. During movement of the cantilever 802, the cantilever 802 via the capping material 410 wipes the fluid-ejection nozzles 204 and the orifice plate 502. The cantilever 802 remains attached to the fluid-ejection mechanism 102 at the portion 804 of the cantilever 802, such that the cantilever 802 flexibly bends to expose the orifice plate 502.

The cantilever 702 can be said to be a wiping mechanism in the embodiment of FIG. 8. As such, the cantilever 702 is movable back and forth from the position depicted in FIG. 8 in which the cantilever 702 covers the orifice plate 502, to another position in which the cantilever 702 no longer covers the portion of the face of the fluid-ejection mechanism 102 containing the orifice plate 502 and the fluid-ejection nozzles 204 of FIG. 2. In this latter position, the fluid-ejection nozzles 204 are exposed, so that fluid ejection therefrom onto media can occur.

Figure 9:
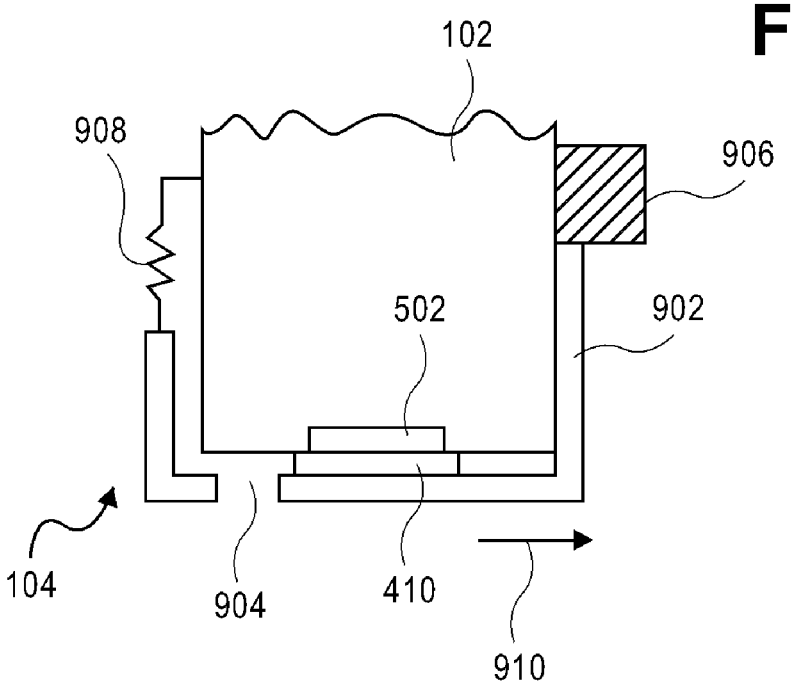

FIG. 9 shows the service station 104 for the fluid-ejection mechanism 102 of the fluid-ejection device 100, according to another embodiment of the invention. The service station 104 includes a non-elastic flexible member 902 defining a slot 904, and the capping material 410. In the closed position as shown in FIG. 9, the orifice plate 502, containing the fluid-ejection nozzles 204 of FIG. 2 that are not shown in FIG. 9, is not exposed. Rather, the capping material 410 covers the orifice plate 502.

The non-elastic flexible member 902 at one end is attached to a mechanical actuator 906, and at another end is attached to a tension spring 908. Moving the mechanical actuator 906 upwards causes the non-elastic flexible member 902 to move to the right, as indicated by the arrow 910. As such, the capping material 410 no longer covers the orifice plate 502 and the fluid-ejection nozzles 204 of FIG. 2, and the plate 502 and the nozzles 204 become exposed through the slot 904 within the non-elastic flexible member 902. During movement of the non-elastic flexible member 902, the non-elastic flexible member 902 via the capping material 410 wipes the fluid-ejection nozzles 204 and the orifice plate 502.

The non-elastic flexible member 902 can be said to be a wiping mechanism in the embodiment of FIG. 9. As such, the non-elastic flexible member 902 is movable back and forth from the position depicted in FIG. 9 in which the orifice plate 502 is covered by the capping material 410, to another position in which the orifice plate 502 is exposed through the slot 904. In this latter position, the fluid-ejection nozzles 204 of FIG. 2 are exposed, so that fluid ejection onto media can occur. Releasing the mechanical actuator 906 results in the spring 908 pulling the non-elastic flexible member 902 back to the position depicted in FIG. 9, in which the orifice plate 502 and the fluid-ejection nozzles 204 are not exposed.

Figure 10:
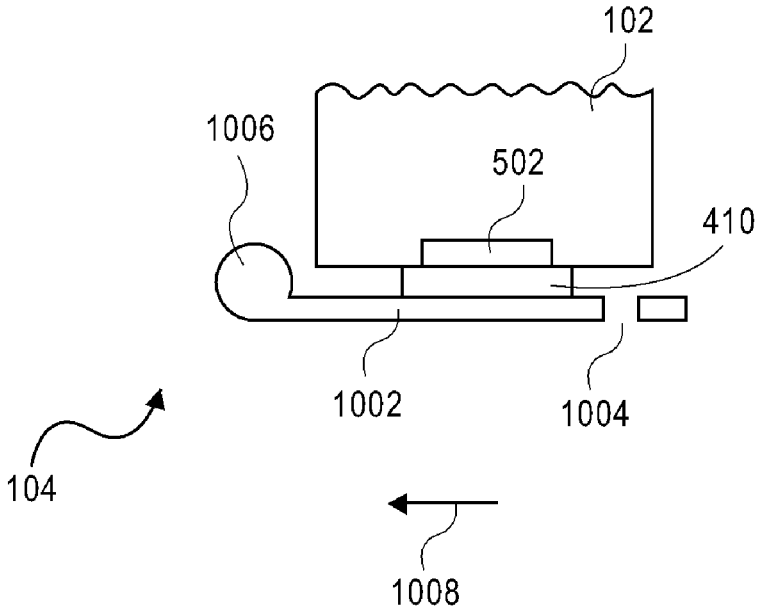

FIG. 10 shows the service station for the fluid-ejection mechanism 102 of the fluid-ejection device 100, according to another embodiment of the invention. The service station 104 includes a non-elastic flexible member 1002 defining a slot 1004, and the capping material 410. The non-elastic flexible member 1002 is again flexible. In the closed position as shown in FIG. 10, the orifice plate 502, containing the fluid-ejection nozzles 204 of FIG. 2 that are not shown in FIG. 10, is not exposed. Rather, the capping material 410 covers the orifice plate 502.

The non-elastic flexible member 1002 is rolled within a roll 1006. Winding the non-elastic flexible member 1002 within the roll 1006 causes the non-elastic flexible member 1002 to move to the left, as indicated by the arrow 1008. As such, the capping material 410 no longer covers the orifice plate 502 and the fluid-ejection nozzles 204 of FIG. 2, and the plate 502 and the nozzles 204 become exposed through the slot 1004 within the non-elastic flexible member 1002. During movement of the non-elastic flexible member 1002, the non-elastic flexible member 1002 via the capping material 410 wipes the fluid-ejection nozzles 204 and the orifice plate 502.

The non-elastic flexible member 1002 likewise can be said to be a wiping mechanism in the embodiment of FIG. 10. As such, the non-elastic flexible member 1002 is movable back and forth from the position depicted in FIG. 10 in which the orifice plate is covered by the capping material 410, to another position in which the orifice plate 502 is exposed through the slot 1004. In this latter position, the fluid-ejection nozzles 204 of FIG. 2 are exposed, so that fluid ejection onto media can occur. The non-elastic flexible member 1002 is unwound from the roll 1006 to move the non-elastic flexible member 1002 back to the position depicted in FIG. 10, in which the orifice plate 502 and the fluid-ejection nozzles 204 are not exposed.

Embodiments of a service station 104 for a fluid-ejection mechanism 102 of a handheld fluid-ejection device 100 have been presented herein that can remain mounted on the fluid-ejection mechanism 102 while the mechanism 102 is used to eject fluid onto media. Such a servicing station 104 generally includes a wiping mechanism and a capping mechanism. The wiping mechanism is that which moves back and forth over the fluid-ejection mechanism 102, to directly and/or indirectly wipe the fluid-ejection mechanism 102. The capping mechanism is that which caps the fluid-ejection mechanism 102 during periods of nonuse of the fluid-ejection device 100. The capping mechanism can also be that which actually contacts the fluid-ejection mechanism 102 during wiping by the wiping mechanism.

We claim:

1. A service station for a fluid-ejection mechanism of a fluid-ejection device, comprising:

a plurality of mechanisms to move back and forth over the fluid-ejection mechanism to wipe the fluid-ejection mechanism, and to cap the fluid-ejection mechanism during periods of nonuse of the fluid-ejection mechanism, the mechanisms comprising:

a wiping mechanism to move back and forth over the fluid-ejection mechanism to wipe the fluid-ejection mechanism;

a capping mechanism to cap the fluid-ejection mechanism during periods of nonuse of the fluid-ejection mechanism; and, a housing mountable on the fluid-ejection mechanism and defining an opening within which the wiping mechanism is movably disposed, such that the wiping mechanism moves back and forth within the opening of the housing to wipe the fluid-ejection mechanism, wherein the service station is mounted on the fluid-ejection mechanism, and remains mounted on the fluid-ejection mechanism while the fluid-ejection mechanism is used to eject fluid, wherein the fluid-ejection mechanism is moved by a user to properly eject the fluid, and wherein the wiping mechanism defines a slot, such that in a first position of the wiping mechanism a plurality of fluid-ejection nozzles of the fluid-ejection mechanism are exposed through the slot, and in a second position of the wiping mechanism the fluid-ejection nozzles are capped by the capping mechanism.

2. The service station of claim 1, wherein the capping mechanism is disposed on an underside of the wiping mechanism and maintains humidification of the fluid-ejection nozzles of the fluid-ejection mechanism.

3. The service station of claim 1, further comprising:

a non-elastic flexible member to move the wiping mechanism to a first position towards a first end of the opening of the housing; and, a spring to move the wiping mechanism back to a second position towards a second end of the opening of the housing.

4. The service station of claim 3, further comprising a mechanical actuator attached to the flexible non-elastic member, such that displacement of the mechanical actuator causes the non-elastic flexible member to move the wiping mechanism to the first position towards the first end of the opening of the housing.

5. The service station of claim 1, wherein movement of the wiping mechanism within the opening of the housing moves any fluid on the fluid-ejection mechanism towards an end of the opening of the housing.

6. The service station of claim 1, wherein the housing on the fluid-ejection mechanism substantially prevents the fluid-ejection mechanism from being incorrectly attached to the fluid-ejection device.

7. The service station of claim 1, wherein the fluid-ejection nozzles are to eject different types of fluid, the mechanisms wiping the fluid-ejection mechanism such that each fluid-ejection nozzle remains substantially uncontaminated by fluid of a different type than that which the fluid-ejection nozzles eject.

8. The service station of claim 1, wherein the service station is mountable to the fluid-ejection mechanism such that a distance from the fluid-ejection nozzles to the media on which the fluid is ejected is increased substantially insufficiently to result in degraded image-formation quality on the media.

9. The service station of claim 1, wherein the service station is removably attached to the fluid-ejection mechanism.

10. A fluid-ejection assembly for a handheld fluid-ejection device comprising:

a fluid-ejection mechanism to eject fluid onto media; and, a service station affixed to the fluid-ejection mechanism to wipe the fluid-ejection mechanism and cap the fluid-ejection mechanism during periods of nonuse of the fluid-ejection mechanism, wherein the service station remains affixed to the fluid-ejection mechanism while the fluid-ejection mechanism is used to eject fluid onto media, wherein the fluid-ejection device is handheld and is moved by a user to properly eject the fluid onto the media, wherein the service station comprises:

a wiping mechanism to move back and forth over the fluid-ejection mechanism to wipe the fluid ejection mechanism;

a capping mechanism to cap the fluid-ejection mechanism during periods of nonuse of the fluid-ejection mechanism and, a housing mounted on the fluid-ejection mechanism and defining an opening within which the wiping mechanism is movably disposed, such that the wiping mechanism moves back and forth within the opening of the housing to wipe the fluid-ejection mechanism, and wherein the wiping mechanism defines a slot, such that in a first position of the wiping mechanism a plurality of fluid-ejection nozzles of the fluid-ejection mechanism are exposed through the slot, and in a second position of the wiping mechanism the fluid-ejection nozzles are capped by the capping mechanism.

11. The fluid-ejection assembly of claim 10, wherein the service station is at least substantially permanently affixed to the fluid-ejection mechanism.

12. The fluid-ejection assembly of claim 10, wherein an area of the fluid-ejection mechanism adjacent to the service station is rendered hydrophobic.

13. The fluid-ejection assembly of claim 10, wherein the capping mechanism is disposed on an underside of the wiping mechanism and maintains humidification of the fluid-ejection nozzles of the fluid-ejection mechanism.

14. The fluid-ejection assembly of claim 10, further comprising:

a non-elastic flexible member to move the wiping mechanism to a first position towards a first end of the opening of the housing; and, a spring to move the wiping mechanism back to a second position towards a second end of the opening of the housing.

15. The fluid-ejection assembly of claim 10, wherein movement of the wiping mechanism within the opening of the housing moves any fluid on the fluid-ejection mechanism towards an end of the opening of the housing.

16. The fluid-ejection assembly of claim 10, wherein the housing on the fluid-ejection mechanism substantially prevents the fluid-ejection mechanism from being incorrectly attached to the fluid-ejection device.

17. The fluid-ejection assembly of claim 10, wherein the fluid-ejection nozzles are to eject different types of fluid, the mechanisms wiping the fluid-ejection mechanism such that each fluid-ejection nozzle remains substantially uncontaminated by fluid of a different type than that which the fluid-ejection nozzles eject.

18. The fluid-ejection assembly of claim 10, wherein the service station is mounted to the fluid-ejection mechanism such that a distance from the fluid-ejection nozzles to the media on which the fluid is ejected is increased substantially insufficiently to result in degraded image-formation quality on the media.

19. A service station for use with a fluid-ejection device having a replaceable fluid-ejection mechanism with at least one fluid-ejection nozzle, at least the fluid-ejection mechanism being held and moved by a user during a fluid-ejection operation, the service station comprising:

a housing configured to attach to the fluid-ejection mechanism and to remain attached to the fluid-ejection mechanism during the fluid-ejection operation; and, a shutter arranged within the housing, and including at least one opening, wherein the shutter is selectively moveable between at least two different positions with respect to the fluid-ejection nozzle, such that in a first position the opening exposes the fluid-ejection nozzle and in a second position the fluid-ejection nozzle is covered, and when the shutter is moved between the first and the second positions at least a portion of the shutter contacts and wipes the fluid-ejection nozzle.

20. The service station of claim 19, further comprising at least one capping material that is in contact with the fluid-ejection nozzle when the shutter is in the second position.

* * * * *